United States Patent [19]

Lindsey

[11] Patent Number: 4,511,060

[45] Date of Patent: Apr. 16, 1985

[54] ANTITHEFT SIDE MOUNTED ESCROWS FOR VENDING MACHINE

[75] Inventor: James C. Lindsey, Chattanooga, Tenn.

[73] Assignee: Cavalier Corporation, Chattanooga, Tenn.

[21] Appl. No.: 502,626

[22] Filed: Jun. 9, 1983

[51] Int. Cl.[3] ..... G07F 11/10

[52] U.S. Cl. ..... 221/115; 221/194; 221/241; 221/289; 221/295; 221/301

[58] Field of Search ..... 221/67, 93–94, 221/112, 114–118, 193–196, 241, 123–125, 289, 299–301, 295–296

[56] References Cited

U.S. PATENT DOCUMENTS

| | | | |
|---|---|---|---|
| 3,209,942 | 10/1965 | Gaparini et al. | 221/67 |
| 3,224,631 | 12/1965 | Payne | 221/15 |
| 3,300,084 | 1/1967 | Payne | 221/15 |
| 3,356,259 | 12/1967 | O'Neal | 221/118 |
| 3,362,582 | 1/1968 | Gaparini et al. | 221/298 |
| 3,454,192 | 7/1969 | Johnson | 221/67 |
| 3,463,355 | 8/1969 | Ural | 221/67 |
| 3,722,744 | 3/1973 | Payne | 221/129 |
| 3,753,507 | 8/1973 | James | 221/301 X |
| 3,799,393 | 3/1974 | Baxendale | 221/67 |
| 3,810,560 | 5/1974 | Stegeman | 221/116 |
| 3,883,038 | 5/1975 | Bookout | 221/67 |
| 3,904,076 | 9/1975 | Payne | 221/67 |
| 4,019,650 | 4/1977 | Oden | 221/116 |
| 4,220,235 | 9/1980 | Lindsey et al. | 221/225 X |
| 4,298,138 | 11/1981 | Oden | 221/115 |

*Primary Examiner*—Charles A. Marmor

*Attorney, Agent, or Firm*—Kerkam, Stowell, Kondracki & Clarke

[57] ABSTRACT

A vending or dispensing machine is operable in triple depth, double depth, and single depth operating modes. A cradle which is rotatable through 360° is used to separate cylindrical articles from a number of tandem nonstaggered vertical columns. The rotatable cradle separates a single can or other cylindrical article from each of the columns disposed in a storage zone above the cylindrical cradle and drops the cans into an escrow zone. One of the cans in the escrow zone is immediately dispensed. If operating in a triple depth mode, the remaining two cans are held by side mounted pivotable escrow members which are controlled and movably operable by the cradle itself. Upon a second activation the cradle moves further in its sequence allowing one of the escrow members to release its hold on a second can such that that can drops into a dispensing zone accessable to a consumer. A further activation of the cradle causes it to release the second escrow member such that the third and last can in the escrow zone is released for gravity movement into the dispensing zone. The cradle then rotates around and segregates three more cans from the columns as the sequence starts over. The side mounted escrow members or gates have a camming surface to advance the point in the operating sequence at which the escrow members are moved to holding positions. A peg arrangement or mounting flange arrangement is used to lock the removable escrow members against removal by unauthorized persons.

25 Claims, 15 Drawing Figures

ANTITHEFT SIDE MOUNTED ESCROWS FOR VENDING MACHINE

BACKGROUND OF THE INVENTION

This invention relates to a dispensing apparatus. More specifically, this invention relates to a vending machine for vending cans, bottles, or similar generally cylindrical articles.

It is well known in the art to use vending machines wherein cans or bottles are stored in a number of tandem vertical columns. Means are usually provided at the bottom of the columns such that only one can or one bottle is dispensed at a time.

The following patents are illustrative of known vending machine designs:

| U.S. Pat. No. | Inventor | Issue Date |
|---|---|---|
| 3,209,942 | Gasparini et al | Oct. 5, 1965 |
| 3,224,631 | Payne | Dec. 21, 1965 |
| 3,300,084 | Payne | Jan. 24, 1967 |
| 3,356,259 | O'Neal | Dec. 5, 1967 |
| 3,362,582 | Gasparini et al | Jan. 9, 1968 |
| 3,454,192 | Johnson | July 8, 1969 |
| 3,463,355 | Ural | Aug. 26, 1969 |
| 3,722,744 | Payne | March 27, 1983 |
| 3,799,393 | Baxendale | March 26, 1974 |
| 3,810,560 | Stegeman | May 14, 1974 |
| 3,883,038 | Bookout | May 13, 1975 |
| 3,904,076 | Payne | Sept. 9, 1975 |
| 4,019,650 | Oden | April 26, 1977 |
| 4,298,138 | Oden | Nov. 3, 1981 |

The Gasparini et al '942 patent discloses a vending mechanism having movable support bars 21 and 22 which are moved by a movable reciprocating carriage (see especially 45 and 46 of FIG. 7).

The Payne U.S. Pat. Nos. 3,224,631, 3,300,084 and 3,904,076 show dispensing machines having upper support rods and a lower support which only supports cans from the front column of two tandem columns. Further, provision is made for dispensing from a single column.

The O'Neal patent shows a vending mechanism with upper and lower gates. As best shown in FIGS. 3–5, the lower gate pivots at point 45 on the side wall.

The Gasparini '582 patent shows a vend plate (see especially FIGS. 4 & 5) pivoting on the side wall. A gating arrangement is above the vend plate.

The P. A. Johnson U.S. Pat. No. 3,454,192 discloses a dispensing apparatus for dispensing cans from three tandem staggered stacks. The sequence of dispensing is front-middle-rear on one sidewall then front-middle-rear from the cans on the other sidewall. Two support members 9L and 9R cooperate with a stepped sidewall having steps 11R, 13R, and 15R (see especially FIG. 2) to selectively release the front, middle, or rear can.

The Ural patent discloses a vending machine adaptable to vend either cans or bottles. A masking plate 86 is used to cover a notch in timing cam 80 (FIG. 8) in order to change the operation from cans to bottles. Additionally, ribs 126 are used to accomplish the bottle/can change-over. Offset wall portion 132 is used to release one can from bail 16, while another can is held.

The Payne U.S. Pat. No. 3,722,744 shows a split vend gate mechanism for dispensing cans from alternate tandem columns by 90° rotation or bottles from a single column by 180° rotation.

The Baxendale patent discloses a vending machine with pivotable side wall mounted members 156 and 158.

The vending mechanism is suitable for single depth vending of bottles (FIGS. 8–11) or double depth vending of cans (FIGS. 12–15). An escrowing assembly includes parts 188 and 190 with width adjustment parts 210′ and 212′ (see especially FIG. 7) to support a can in one column when a can in another column has been released. A programmable cam 110 (FIG. 5) is used.

The Stegeman patent discloses the use of a two-part cradle support (compare especially FIG. 2 and FIG. 3) which may be used to dispense from two tandem stacks of cans or one stack of bottles.

The Bookout patent shows a vending machine with levers 126 and 127 (see especially FIGS. 20 and 21) which sequentially vend cans from different columns.

The Oden U.S. Pat. No. 4,019,650 discloses a vending mechanism for front and back staggered stacks. An upper and lower bale 22 and 24 are fixed together to rotate as a unit. A stepped portion 26 on the lower bail supports a back column can after the dispensing of a front column can.

The Oden U.S. Pat. No. 4,298,138 discloses a vending mechanism having a cradle with steps in order to release a front/back can every one half revolution or one bottle every revolution. The operation of the step cradle is shown in FIGS. 5–11.

Although such prior art machines have been generally useful, these prior art devices have usually been subject to one or more of a number of disadvantages. In particular, many of these constructions have required complex mechanisms which are subject to jamming and/or malfunction. Some of the prior art mechanisms for dispensing from tandem columns have insufficient theft protection. Numerous of the prior art vending mechanisms are not easily adapatable to various sizes of cans, bottles, or similar cylindrical articles. Those prior art devices which provide for different sizes may not have the desirable depth (i.e., they may be limited to a set number of tandem columns). Often these prior art devices are suitable for use with staggered tandem columns, but are not well adapted for use with straight line or nonstaggered tandem columns. Further, several of the prior art devices require the lifting of a column of cans, thereby placing a relatively heavy load on a driving motor which controls the mechanism which must lift the heavy load.

OBJECTS AND SUMMARY OF THE INVENTION

Accordingly, it is a general object of the present invention to provide a new and improved dispensing apparatus.

A further object of the present invention is to provide a dispensing apparatus or assembly which is suitable for sequential dispensing from tandem nonstaggered columns.

Another object of the present invention is to provide a dispensing assembly which is readily adaptable to function in a number of different modes having different configurations of columns.

A still further object of the present invention is to provide a dispensing apparatus wherein it is unnecessary to lift a column of cans or bottles.

Yet another object of the present invention is to provide a dispensing apparatus which is relatively immune to jamming and similar malfunctions.

Another object of the present invention is to provide a dispensing apparatus having various features which minimize the possibility of theft.

The above and other objects of the present invention which will become apparent as the description proceeds are realized by a dispensing apparatus comprising: a compartment with front, back, right side, and left side walls; a storage zone in the compartment and adapted to selectively store a plurality of cylindrical articles in: I. an n column mode with the articles disposed in n axially-aligned vertical column zones extending from the front wall to the back wall, n being an integer $\geqq 2$, and II. an $(n-1)$ column mode with the articles disposed in $(n-1)$ vertical column zone (s), each $(n-1)$ column zone over-lapping at least two of the n column zones; a dispensing zone below the storage zone; and a first gate removably mounted in the compartment and operable to gate cylindrical articles into the dispensing zone, the first gate movable between; I. a holding position wherein it prevents an article from dropping into the dispensing zone, and II. a free position wherein it allows an article to drop into the dispensing zone; and wherein the first gate can not be removed when it is disposed in the holding position and can not be removed when it is disposed in the free position, and the first gate can be removed when disposed in between the holding position and the free position. The dispensing assembly further comprises a gate accommodating means on one of the side walls adapted for mounting the first gate at least at two different locations. The first gate includes an upper arm and a lower arm and the first gate is hingedly mounted on one of the side walls. The upper arm has an upper hole and the lower arm has a lower hole and the one of the side walls includes at least an upper peg and a lower peg, the upper peg being operative to extend through the upper hole and prevent removal of the first gate when it is in its holding position, and the lower peg is operative to extend through the lower hole and prevent the removal of the first gate when it is in its free position. A pocket on one of the side walls is operable to mount the first gate by receiving a hinge leaf hinged to the first gate. Alternately, the lower arm includes a lower mounting hole and the assembly further comprises a first mounting flange extending out from one of the side walls, and wherein the first gate is mounted by the first mounting flange extending through the lower hole. The upper arm includes a flange extending out therefrom. The assembly further comprises an escrow zone in the compartment between the storage zone and the dispensing zone; a curved cradle blocking movement of articles from the storage zone to the escrow zone and operable for separating the lower-most article in the column zones from the remainder of articles in the column zones and further operable for simultaneously releasing one article from each of the column zones for gravity movement into the escrow zone; and wherein the cradle is operable to hold the first gate in its holding position and operable to rotate in order to release the first gate which in turn releases an article to move from the escrow zone to the dispensing zone. A second gate is mounted in the compartment in like fashion to the first gate.

The present invention may alternately be described as a dispensing assembly comprising: a compartment with front, back, right side, and left side walls; a storage zone in the compartment and adapted to selectively store a plurality of cylindrical articles in a column or columns; a dispensing zone below the storage zone; and a first gate removably mounted in the compartment and operable to gate cylindrical articles into the dispensing zone, the first gate movable between; I. a holding position wherein it prevents an article from dropping into the dispensing zone, and II. a free position wherein it allows an article to drop into the dispensing zone, the first gate including an upper arm and a lower arm and being pivotable between the holding position and the free position; and wherein the first gate can not be removed when it is disposed in the holding position and can not be removed when it is disposed in the free position and releases an article to move from the escrow zone to the dispensing zone, and wherein the gating member moves the first escrow gate from its free position to its holding position by contacting the camming surface. The camming surface is a flange extending out from the upper arm and is operable to advance the point on an operating sequence of the gating member whereat the first escrow gate will be moved to its holding position. The gating member is a curved cradle. A spring-loaded elevator plate is removably mounted in the cradle to adapt the cradle for operation with relatively small diameter cylindrical articles.

BRIEF DESCRIPTION OF THE DRAWINGS

The above and other features of the present invention which will be more readily understood when considered with the following detailed description in conjunction with the accompanying drawings wherein like characters represent like parts throughout the several views and in which.

BRIEF DESCRIPTION OF THE PREFERRED EMBODIMENTS

Figure 1:
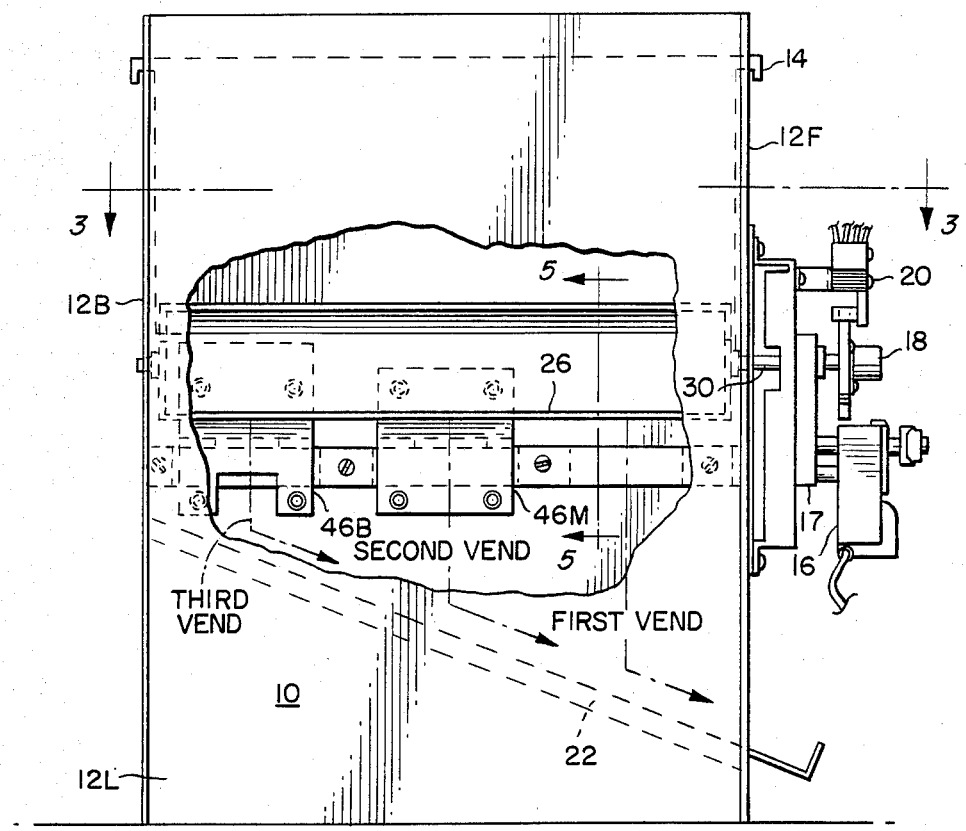
FIG. 1 shows a left side view of an embodiment of the present invention with parts of the left sidewall broken away for clarity.
Figure 3:
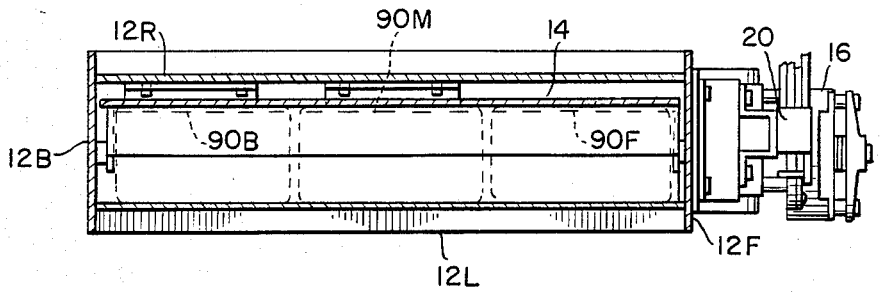
FIG. 3 shows a cross-sectional top view taken along lines 3—3 of FIG. 1.
Figure 2:
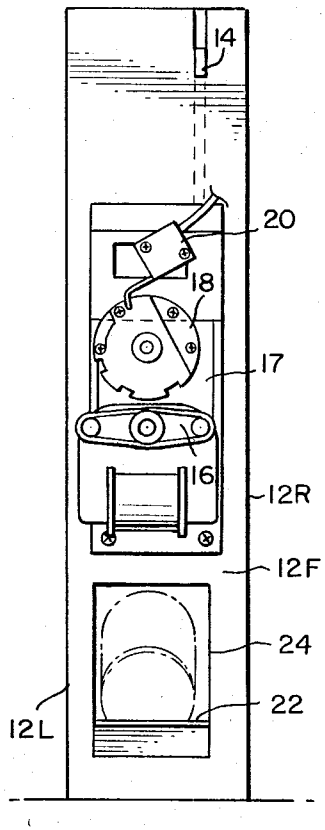
FIG. 2 shows a front view of an embodiment of the present invention.

Turning now to FIGS. 1, 2, and 3 a dispensing assembly 10 of the present invention will be discussed in detail. FIG. 1 shows a front view with parts of a left sidewall 12L broken away for clarity purposes. FIG. 2 shows a front view, whereas FIG. 3 shows a top cross-section taken along lines 3—3 of FIG. 1.

The dispensing assembly 10 includes front wall 12F, back wall 12B, right wall 12R, and left wall 12L. A side spacer 14 may be mounted within the confines of the walls in order to adapt the dispensing assembly 10 to vend articles of smaller diameter than the distance between walls 12R and 12L.

Mounted on the front wall 12F is a motor 16, a cam 18 driven by the motor 16 by way of gear box 17. The cam 18 controls a switch 20 which in turn powers the motor 16. The arrangement of the motor 16, gear box 17, cam 18, and switch 20 is essentially the same as the corresponding parts disclosed in U.S. patent application Ser. No. 347,038, filed on Feb. 8, 1982 now U.S. Pat. No. 4,460,102, issued July 17, 1984 by James C. Lindsey, assigned to the assignee of the present invention, and hereby incorporated by reference. The control circuitry for the motor 16 is the same as that disclosed in U.S. Pat. No. 4,220,235, issued Sept. 2, 1980 to James C. Lindsey and Gregory S. Morgan. This patent is incorporated by reference.

A vend or dispense chute allows cans to slide through a hole 24 in the front wall 12F. As best shown in FIG. 3, cans are arranged in front, middle, and rear columns, only cans 90F, 90M, and 90B being shown in phantom line in FIG. 3.

FIG. 3 shows the right sidewall 12R somewhat recessed behind the right edges of front and back walls 12F and 12B. As will be readily appreciated by those of skill in the art, the present mechanism 10 would actually be mounted within a cabinet (not shown) which would preferrably be refrigerated. Additionally, the mechanism 10 would be adjacent to a similar mechanism or, for example, could be adjacent to a dispensing assembly as shown in the above-identified incorporated by reference patent application Ser. No. 347,038 of James C. Lindsey. The dispensing assembly disclosed in this Lindsey application is especially well adapted for use with staggered stacks of vertical columns, whereas the present invention is useful for nonstaggered or straight line vertical columns. Accordingly, if the present dispensing assembly 10 is placed adjacent to the dispensing assembly disclosed in the Lindsey application, a single common wall could be used between the two dispensing assemblies. The Lindsey assembly may be used to hold a high volume product whereas the present invention could be used to hold a lower volume product. For example, the Lindsey dispensing assembly could be loaded with cola and the present invention could be loaded with root beer. Since the present invention uses nonstaggered stacks or columns, it would hold fewer soft drinks, but would have the advantage of taking up less space.

The use of dispensing assemblies within a refrigerated cabinet including many different dispensing assemblies is well-known in the art and, therefore, need not be described in detail herein. As known in the art, the vend or dispense chute 22 may lead to a user or consumer accessable area with one or more other vend chutes from different dispensing assemblies leading to the same consumer accessable area.

Continuing to consider FIGS. 1-3 and also considering the exploded perspective of FIG. 4, the dispensing mechanisms within the dispensing assembly 10 will be discussed in detail. A curved cradle 26, which is preferrably semicylindrical as shown, is mounted to rotate 360° about axis 28. Specifically, the cradle 26 is rotated by the shaft 31 extending from cam 18 into the cradle's front receiving hole 27F. Back receiving hole 27B has a pin (not shown) to mount it on back wall 12B. An elevator plate 32 may be mounted within slots 29SF and 29SB. As shown, the leading edge 29L and the trailing edge 29T of cradle 26 are straight lines and are parallel to the axis of rotation 28.

Figure 4:
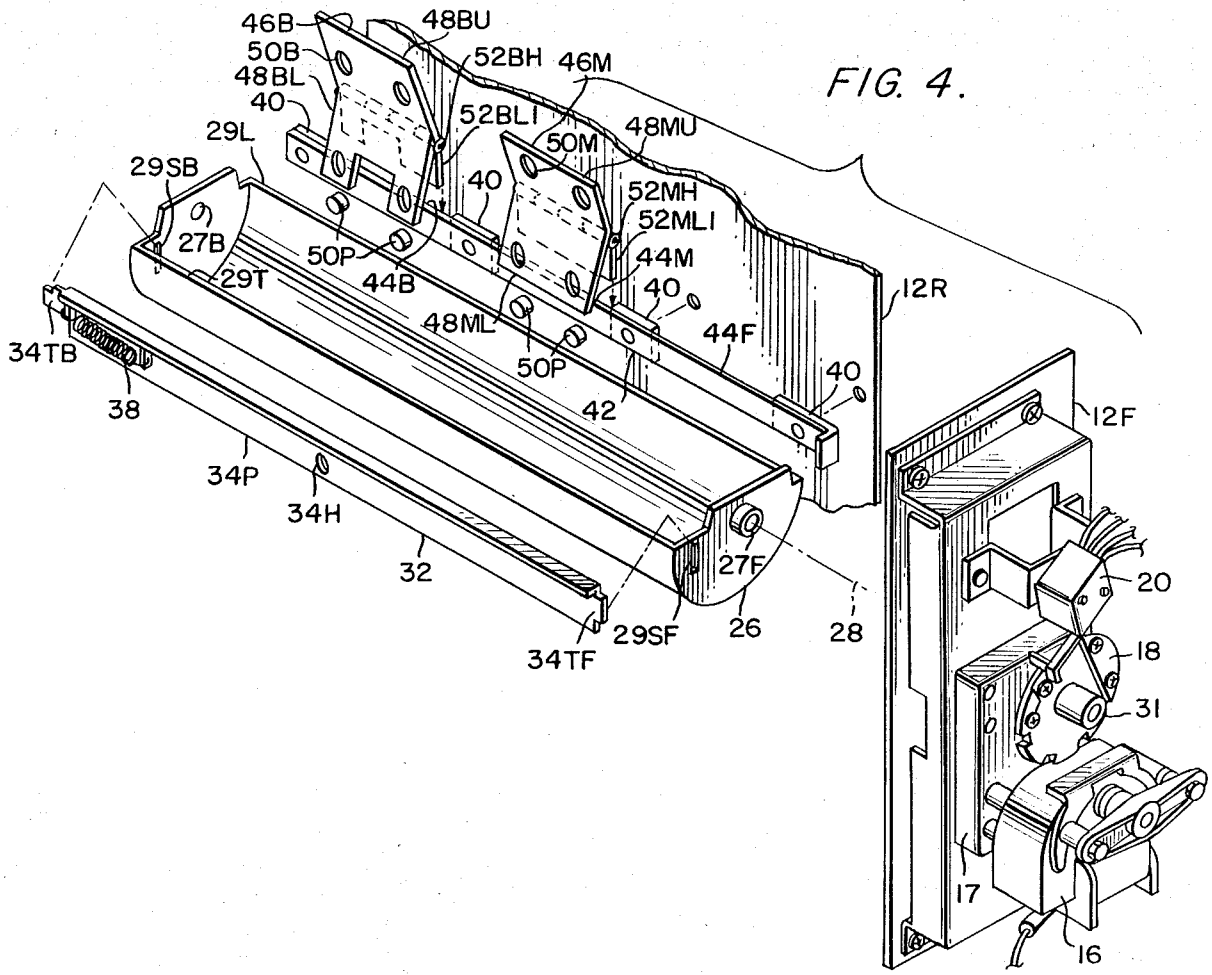
FIG. 4 shows an exploded perspective view of several parts of the present invention.

The right sidewall 12R, which is shown partially broken away in FIG. 4, has stand off plates 40 mounted as illustrated. A strip 42 is mounted parallel to the right wall 12R and spaced therefrom by the stand off plates 40. The stand off plates 40 and the metallic strip 42 are fixed to the wall 12R to define a front pocket 44F, a middle pocket 44M, and a back pocket 44B.

Disposed within the middle pocket 44M is a removable side-mounted escrow member 46M. Likewise, a back side-mounted escrow member 46B is removably mounted within the back pocket 44B. The middle escrow member 46M includes an upper arm 48MU and a lower arm 48ML. The back escrow member 46B is contructed in similar fashion with upper arm 48BU and lower arm 48BL. Disposed within the upper arm and lower arm of middle escrow member 46M are four holes 50M (only one of which is labeled for simplicity sake), whereas the back escrow member 46B likewise includes four holes 50B.

Considering now FIGS. 5-8 in conjunction with FIG. 4, the mounting and operation of the side escrow members 46M and 46B as well as the cradle 26 will be discussed in detail. FIGS. 5-8 show a front cross-sectional view taken along lines 5—5 of FIG. 1.

The middle side escrow 46M is mounted by sliding a first middle hinge leaf 52ML1 into the pocket 44M. As best shown in FIGS. 5-8, the hinge leaf 52ML1 is hinged at middle hinge 52MH to a second middle hinge leaf 52ML2 which is fixed to the back of the lower arm 48ML. The back escrow member 46B is mounted in a similar fashion with a hinge leaf 52BL1 (visible in FIG. 4 only) and a hinge 52BH. A hinge leaf 52B62 similar to 52ML2 would be secured to the back of the lower arm 42BL, this hinge leaf being visible in FIG. 7 only. Once the hinge leaf 52ML1 is inserted in the middle pocket 44M and the hinge leaf 52BL1 is inserted in the back pocket 44B, the two escrow members 46M and 46B are pivotably mounted on the sidewall 12R.

The compartment defined by the walls 12F, 12B, 12R, and 12L includes a storage zone 56S disposed above the cradle 26, an escrow zone 56E just below the cradle 26, and a dispensing zone 56D below the escrow members 46M and 46B and below the escrow zone 56E.

OPERATION

Figure 5:
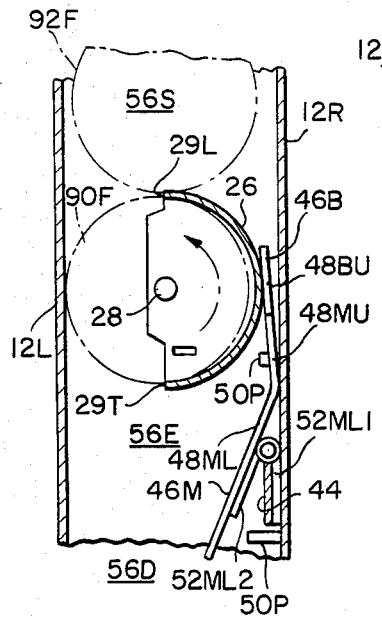
FIGS. 5, 6, 7, and 8 show a cross-section view taken along lines 5—5 of FIG. 1, each figure representing parts of the present invention in different positions as the present invention moves through an operating sequence.
Figure 6:
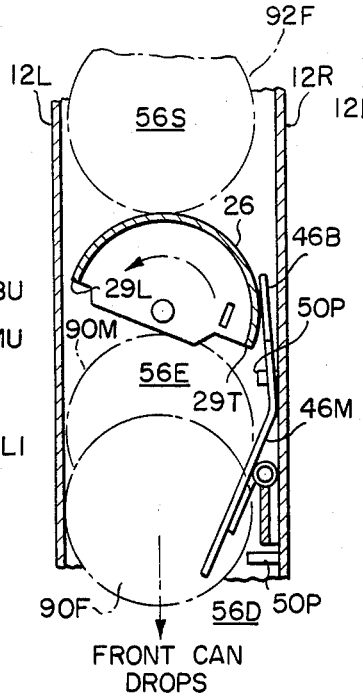

FIG. 5 shows the cradle 26 holding three cans, 90F, 90M, and 90B. Because of the plane front view of FIG. 5, only front can 90F is visible within the cradle. It will be readily understood that cans 90M and 90B are disposed directly behind the can 90F. Disposed above the cradle 26 in the storage zone 56S is the can 92F. A middle and back can would be disposed directly behind the can 92F and additional cans may be disposed on top of these front, middle, and back cans in order realize a straight line stack or vertical column. As shown in the view of FIG. 5, the cradle 26 has pushed the upper arms 48MU and 48BU of the respective middle escrow member 46M and back escrow member 46B adjacent the right sidewall 12R. The cam 18 together with the switch 20 and motor 16 would cause the cradle 26 to stop in the position shown in FIG. 5.

When a consumer inserts money to actuate the vend motor 16 in the manner described in the incorporated by reference Lindsey et al U.S. Pat. No. 4,220,235, the motor will rotate the cradle 26 in a counter clockwise direction to the position shown in FIG. 6. The three cans 90F, 90M, and 90B will drop out of the cradle 26 and fall into the escrow zone 56E. The front can 90F will fall right through the escrow zone 56E into the dispensing zone 56D. Recalling FIG. 4 momentarily, the preferred embodiment does not have a side escrow member in the front portion of the escrow zone 56E. Accordingly, the can 90F will fall to the dispense chute 22 (FIG. 1) and will be accessible to the consumer who has placed his money in the machine. By contrast, the middle can 90M and the back can 90B (behind 90M in FIG. 6) will be trapped between the left wall 90L and the respective lower arms 48ML and 48BL of the side escrow members 46M and 46B. Most importantly, the cradle 26 will maintain the upper arms 48MU and 48BU of the escrow members adjacent the wall 12R, thus preventing the weight of the cans from moving or pivoting the escrow members or gates 46M and 46B from their holding positions.

Figure 7:
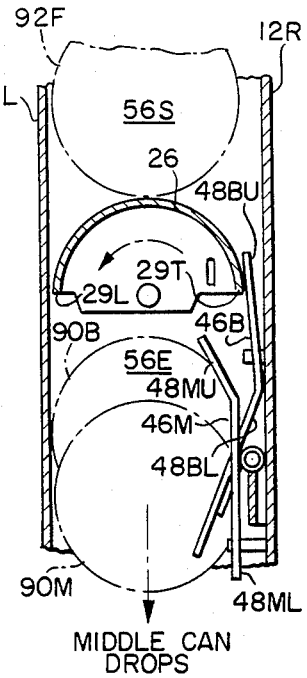

When the next consumer inserts his money, the vend motor 16 and cam 18 will cause the cradle 26 to move to the position shown FIG. 7. The upper arm 48MU of the middle escrow 46M will now be free of the cradle 26 and the weight of the middle can 90M will cause the middle escrow 46M to assume its free position (lower arm 48ML adjacent wall 12R, upper arm 48MU away from wall 12R) shown in FIG. 7, the middle can 90M dropping from the escrow zone 56E into the dispensing zone 56D and becoming accessible to the consumer by way of vend chute 22. Because of the differing lengths of the upper arm 48MU of middle escrow 46M and the upper arm 48BU of back escrow 46B, the cradle 26 will maintain the back escrow 46B in its holding position (FIG. 7) to block movement of the back can 90B between lower arm 48BL and left wall 12L. Accordingly, in the position shown in FIG. 7 a single can 90B is still disposed in the escrow zone 56E.

When a third consumer actuates the machine, the vend motor causes the cradle 26 to rotate further counter clockwise from the position shown in FIG. 7 such that the upper arm 48BU will be clear of the leading edge 29L of the cradle 26. Accordingly, the weight of the back can 90B as well as the weight of the back escrow 46B itself will cause it to flip into the position shown in FIG. 8. The back can 90B will then drop from the escrow zone 56E into the dispensing zone 56D and slide down the chute 22 to become accessible to the consumer. The cradle 26 continues rotating around after the trailing edge 29T is clear of the back upper arm 48BU. The cradle 26 rotates continuously from the FIG. 7 position through the position shown in FIG. 8 back into the position shown in FIG. 5. When the cradle 26 reaches the position of FIG. 8, it begins to push the upper arms 48BU and 48MU of the two escrow members and will push them away from the center of the escrow zone 56E such that the lower arms 48ML and 48BL will move towards the center of the escrow zone 56E. Accordingly, the escrow members 46M and 46B will return to their holding positions shown in FIG. 5.

Figure 8:
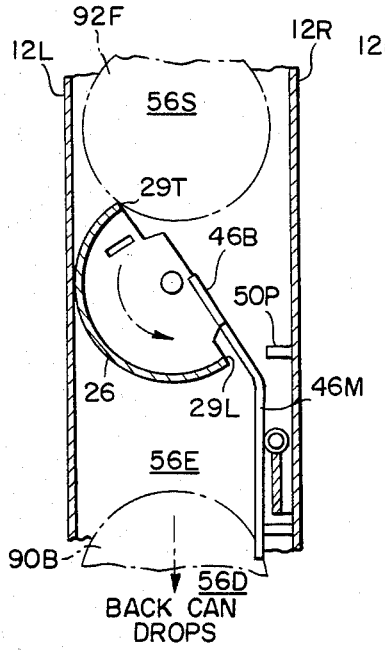

As the cradle 26 moves continuously from its position of FIG. 7 through the position of FIG. 8, can 92F and two cans behind it will drop into the cradle 26 such that the cradle 26 and the mechanism will return to the position shown in FIG. 5. When the next consumer actuates the machine, the vend motor 16, cam 18, and switch 20 will serve to move the cradle 26 to the position shown in FIG. 6, dispensing the front can 92F and repeating the cycle of operation until all of the cans from the storage zone 56S have been dispensed or vended.

OPERATION FOR SMALLER DIAMETER CANS

Figure 9:
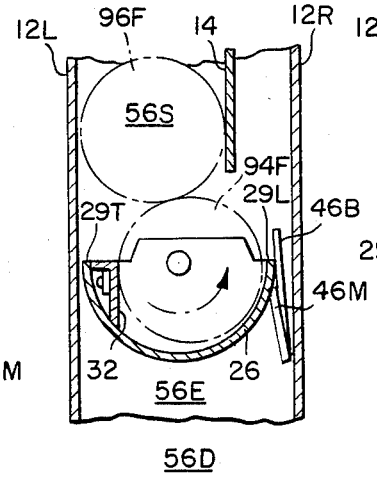
FIGS. 9 and 10 show cross-section view taken along lines 5—5 of the present mechanism and illustrating an operating sequence adapted for a smaller diameter can or bottle.
Figure 10:
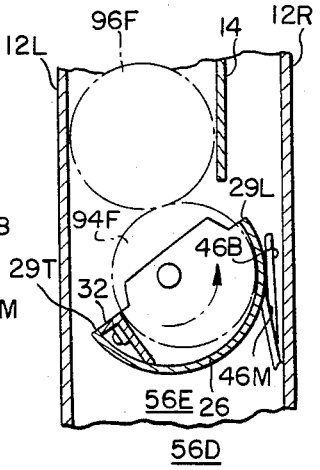

Considering FIGS. 9, 10, and 11 in conjunction with FIG. 4, the elevator plate 32 will be discussed in detail. In order to allow the cradle 26 to adapt to cans or bottles having a diameter smaller than the diameters shown in FIGS. 5–8, a side spacer 14 (FIGS. 9 and 10 as well as FIGS. 1 and 2) is placed adjacent the right side wall 12R. As best shown in FIGS. 9 and 10, which are cross-sections along lines 5—5 of FIG. 1, the side spacer 14 effectively reduces the width of the front, middle, and back column zones disposed within the storage zone 56S.

In order to accommodate the cradle 26 to the smaller diameter cans or bottles, the elevator plate 32 is inserted with its tabs 34TF and 34TB within the respective slots 29SF and 29SB (see especially FIG. 4). The front tab 34TF is integral with a plate member 34P, whereas the back tab 34TB is a part of a tab member 37 slidably mounted under the mounting plate 6 and having springs 38 to resist compression or sliding of the tab member 37 towards the center of the plate member 34P. The elevator plate 32 including plate member 34P is easily inserted into the slots 29SF and 29SB by simply inserting the back spring loaded tab 34TB into the back slot 34SB and placing one's finger in the hole 34H (FIG. 4) to push the plate member 34P backwardly. This compresses or slides the tab member 37 towards the hole 34H and allows the front tab 34TF to be inserted in slot 29SF. The springs 38 cause the tab 34TB and the plate member 34P to telescope away from each other, thereby locking the elevator plate 32 into the position shown in FIGS. 9 and 10.

The operation of the elevator plate 32 will serve to effectively reduce the diameter of the cradle 26. More specifically, and especially with reference to FIG. 10, the elevator plate 32 will prevent the cradle 26 from having to lift the stack of cans above and including can 96F. Consider for example, if the elevator plate 32 was not included in the cradle when used with cans of the diameter shown in FIGS. 9 and 10. Once the can 94F had disposed itself within the cradle 26, it would be closer to the trailing edge 29T of the cradle 26. Accordingly, the can 96F supported above the can 94F would be in a lower position in FIG. 10. When the cradle 26 sweeps around to separate can 94F from can 96F, it would cut into the can 96F possibly jamming itself or, alternately, it would have to lift up the can 96F as well as any cans disposed above 96F. Placing such a heavy load on the motor would be highly disadvantageous. Accordingly, the elevator plate 32 keeps the can 94F disposed higher than it would otherwise be in the FIG. 10 position. When the cradle 26 sweeps around to separate can 94F from can 96F (as well as like situated middle and back column cans) the cradle leading edge 29L will be properly positioned to sweep between cans 94F and 96F without having to lift the column of cans.

Figure 11:
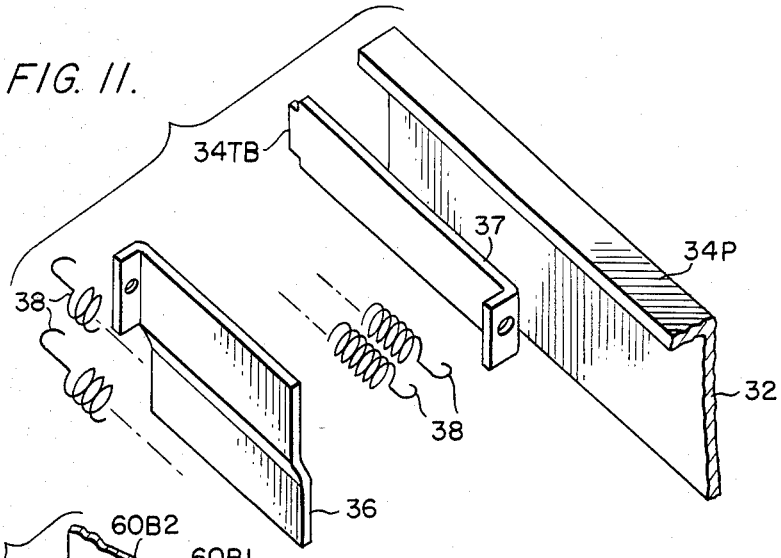
FIG. 11 shows an exploded view of several parts of an elevator plate used with the present invention.

The side escrow members 46M and 46B are only partially shown in FIGS. 10 and 11. Their operation is the same in this set-up as in FIGS. 5—8 without the elevator plate 32.

ADJUSTING FOR DOUBLE OR SINGLE DEPTH VENDING

As discussed so far, the present invention can dispense one can or bottle at a time from a storage zone having three tandem nonstaggered columns. Referring back to the drawing of FIG. 4, a simple procedure for allowing the present mechanism to work for double or single depth dispensing will be discussed.

In order to adapt the invention to work for single depth dispensing, the two side escrow members 46M and 46B may simply be removed. Accordingly, when the cradle 26 moves from the position shown in FIG. 5 to the position shown in FIG. 6, a single longer length cylindrical article may freely drop from the cradle 26 through the escrow zone 56E into the dispensing zone 56D. In addition to removing the side escrows 46M and 46B, adjusting for single depth dispensing would require the placement of masking plates on the cam notches of cam 18 such that the cradle 26 will only stop in the position shown in FIG. 5. In other words, cradle 26 will be in the position shown in FIG. 5 and will simply rotate 360° dispensing one long cylindrical object each time. The adjustments to the cam 18 by the use of masking plates are well-known in the art and, for example, discussed in detail in the incorporated by reference U.S. patent application Ser. No. 347,038 of James C. Lindsey and the above discussed Ural patent among others.

In order to adapt the dispensing assembly 10 of the present invention for dispensing in double depth operation, the cam 18 is simply programmed to stop only in the positions shown in FIG. 5 and FIG. 7. Additionally, the middle escrow gate 46M is removed and the back escrow member 46B is moved forwardly until it lies partly in the pocket 44B and partly in the pocket 44M. As will be apparent from the drawing of FIG. 4, the lower arm 48BL and lower hinge plate 52BL1 are bifurcated such that they may straddle the standoff plate 40 between the back pocket 44B and middle pocket 44M.

In double depth operation, the cradle 26 will contain two cylindrical articles in the FIG. 5 position. The articles such as cans would be longer than the cans used in triple depth. Each of the double depth columns overlap at least two of the triple depth columns. Upon activation by a consumer dropping in his money, the cradle 26 will rotate to the position shown in FIG. 7 such that the front cylindrical article will drop into the dispensing zone 56D. The back cylindrical article will be held in position by the escrow member 46B in the same fashion as shown in FIG. 7. The next activation of the vend motor 16 will cause the cradle 26 to rotate such that the escrow member 46B is freed from the trailing edge 29T of the cradle 26. The back cylindrical article will then drop into the dispensing zone 56D and the cradle 26 will rotate about 270° to return to the position of FIG. 5 whereupon the cycle may be repeated.

Obviously, the side spacer 14 and elevator plate 32 could be used in single or double depth mode in the same manner as discussed for its use in triple depth mode. Further, the use of a rear spacer (not shown) is well-known in the art and could be used in conjunction with double or single depth dispensing wherein the cylindrical articles do not extend completely from the front wall 12F to the back wall 12B.

Although the use of the side escrows 46M and 46B are discussed for double and triple depth dispensing, they could also be used for dispensing from 4 or more tandem columns. The length of the upper arms (such as 48MU and 48BU) of other side escrow members would have different length upper arms. The release points (where the cradle 26 releases the side escrow members) would of course, depend upon the length of the upper arms.

ANTITHEFT FEATURES

An antitheft feature will now be discussed in conjunction with FIGS. 4–8. As shown in FIG. 4 especially, the upper and lower arms 48MU, 48ML, 48BL, and 48BU all include holes 50M and 50B. When the side escrow member 46M is placed into position, the pegs 50P lock the escrow member 46M into position. Specifically, when the escrow member 46M is in its holding position shown in FIG. 5, the pegs 50P extending from the right sidewall 12R above the strip 42 will prevent someone from using a coat hanger or other implement to push the escrow member 46M upwardly. When the side escrow member 46M is in its free position shown in FIG. 7, the pegs 50P disposed below the strip 42 will extend through the holes 50M to prevent the escrow member 46M from being pushed upwardly. In order to remove the escrow member 46M from the pocket 44M, the escrow member 46M would have to be about midway between its holding position of FIG. 5 and its free position of FIG. 7. During the normal operation of the cradle 26, the escrow member 46M never stops in this midway position making it virtually impossible for an unscrupulous consumer to remove the side escrow 46M and thereby obtain two cans for the price of one. Likewise, the back escrow member 46B uses holes 50B and pegs 50P to lock itself into position. It can only be removed when midway between its holding position (FIG. 5) and its free position (FIG. 8).

In order to allow the easy removal of escrow members 46M and 46B by authorized personnel when reprogramming the machine from double depth to triple depth modes, the cam 18 would include a separate notch for service personnel. By removing a face plate from that notch, the cam 18 would stop the cradle into a position such that the side escrows 46M and 46B could be easily pivoted half way between their free and holding positions and removed from their respective side pockets 44M and 44B. Obviously, the cam 18 is inaccessable to the consumer since it is inside of a cabinet housing the mechanism 10.

Figure 12:
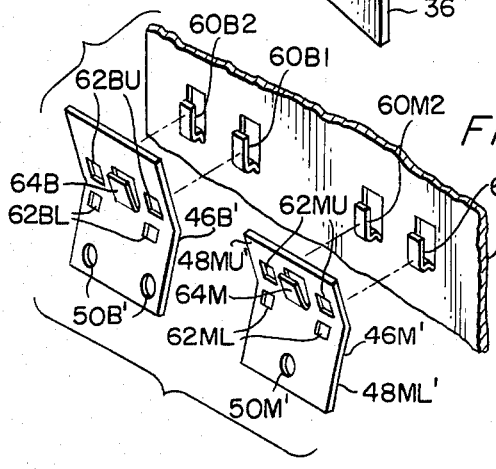
FIG. 12 shows a perspective exploded view of several pieces of an alternate embodiment.
Figure 13:
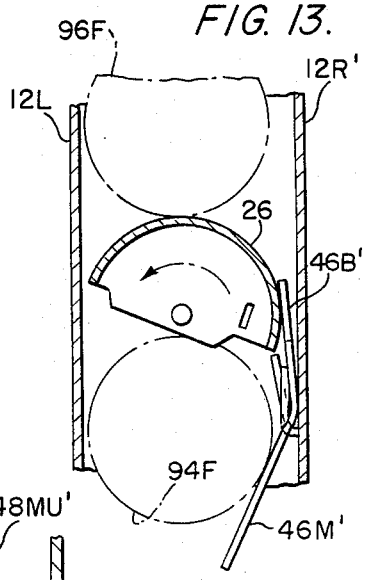
FIGS. 13, 14 and 15 show front cross-section views for different positions of the alternate embodiment shown in FIG. 12.
Figure 14:
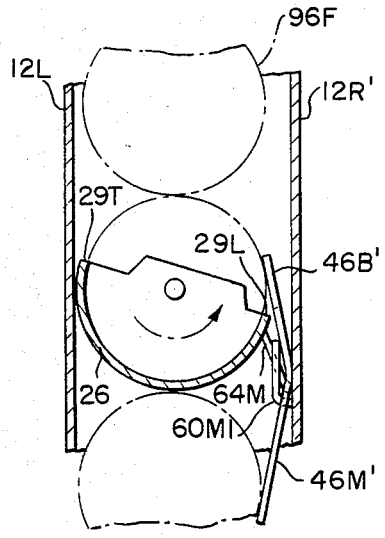
Figure 15:
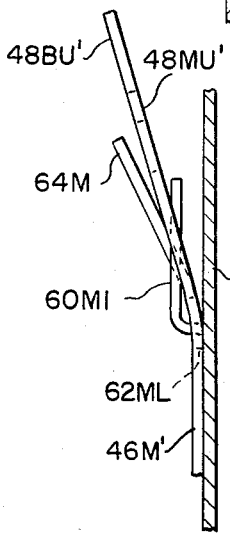

An alternate antitheft mechanism which may be used with the present invention is shown in FIGS. 12–15. FIG. 12 shows a perspective with a portion of an alternately constructed sidewall 12R' and side escrow members 46M' and 46B' FIGS. 13–15 show front cross section views of the FIG. 12 embodiment similar to FIGS. 5–8. As shown, the sidewall 12R' includes four lances or mounting flanges 60M1, 60M2, 60B1, and 60B2 extending inwardly from the wall 12R'.

The middle side escrow gate 46M' is mounted by having the lances 60M1 and 60M2 extend through the lower slots or holes 62ML in the lower arm 48ML'. Likewise, the back escrow member 46B' is mounted by having its slots 62BL receive the sidewall lances 60B1 and 60B2. Slots 62MU and 62BU respectively allow the middle escrow member 46M' and the back escrow member 46B' to pivot on the lances 60M1, 60M2, 60B1, and 60B2. In the absence of the upper slots or holes 62MU and 62BU, the upper arms 48MU' and 48BU' would prevent pivoting of the escrow members.

A flange lance 64M extends out from the middle of the upper arm 48MU', whereas a similar flange lance 64B extends out from the middle of upper arm 48BU'.

The operation of the side escrow members 46M' and 46B' will now be explained. The cradle 26 is in the same position in FIG. 13 as it is in FIG. 6. The lance 64M will prevent an unscrupulous consumer from using a coat hanger to lift the escrow member 46M' away from the wall 12R and up. Specifically, the lanced flange 64M will hit into the cradle 26 to prevent the escrow member 46M' from being lifted. Likewise, the lanced flange 64B on back escrow 46B' will prevent it from being lifted directly up. In other words, when the escrow members 46M' and 46B' are in their holding position (i.e., their upper arms are disposed adjacent to the sidewall 12R') the lance flanges 64M and 64B serve to prevent them from being slid out of position.

When the escrow members 46M' and 46B' are in their free position as in FIG. 15 (their lower arms are against the right sidewall 12R'), the bottom of the slots 62ML will hit the lances 60M1 and 60M2 if an attempt is made to lift the escrow member 46M' directly upwardly. If an attempt is made to lift escrow 46B' or 46M' away from the wall 12R' while in their free positions, the upper arm 48BU' or 48MU' would hit the cradle 26 before the escrow member is free from its supporting lances 62M1, 62M2, 62B1, and 62B2. Accordingly, the side escrow 46M' and the back escrow 46B' (identically constructed to the side escrow except that it includes a longer upper arm 48BU') may not be removed from the sidewall 12R' by an unscrupulous consumer.

As with the embodiments using the pegs for holding the side escrow members on the right sidewall, an authorized person may stop cradle 26 intermediate to its usual positions to allow the side escrows to be removed.

If desired, a single hole 50M may be included in the middle escrow 46M', whereas two holes 50B' may be included in the back escrow 46B'. The holes may simply be used to identify and distinguish the escrows.

In addition to serving as an antitheft feature, the lance flanges 64M and 64B are quite useful in avoiding the jamming of the respective upper arms 48MU' and 48BU'. Specifically, as shown in FIG. 14, the flanges 64M cause the upper arm 48MU' to move immediately adjacent the wall 12R' earlier in the cycle of operation of cradle 26 then would otherwise would be the case. As soon as the leading edge 29L moves up the camming surface of flange 64M, the upper arm 48MU' will be moved immediately adjacent to the wall 12R'. This will prevent the upper arms 48BU' and 48MU' from interfering with cans such as 98F which are dropping into the cradle 26. Basically then, the flange lances 64M and 64B are operable to advance the point in the cradle operating sequence at which their respective escrow side members are moved into the holding position.

Depending upon the length of the upper arms 48MU' and 48BU', the flange lances 64M and 64B serve to minimize the possibility of interference between the upper arms and cans located above the cradle 26 as well as providing theft protection.

The antitheft features as described above could be used with a double depth or for other depth modes of dispensing. The double depth operation, the middle escrow gate 46M' could be removed and the back escrow gate 46B' could be mounted forward on mounting flanges 60M2 and 60B1 which preferably would have the same distance in between them as flanges 60B1 and 60B2. By equally spacing the flanges 60M1, 60M2, 60B1, and 60B2 and using the masking cam 18, double depth operation could be obtained. Single depth operation could be obtained by removing gates 46M' and 46B' and reprogramming cam 18 as above. Likewise, the feature of having the lance flanges 64M and 64B is broadly applicable to moving side escrow members into position at a different point in the sequence of operations of an upper gating member such as cradle 26.

The elevator plate and antitheft features including the peg arrangements and the lanced side escrows of FIGS. 12–15 were invented by the present inventor as modifications and/or improvements of the basic side mounted escrows invented by Marvin R. Manzer as claimed in a separate patent application titled VENDING MACHINE WITH SIDE MOUNTED ESCROWS and on May 26, 1983 Ser. No. 498,560 and assigned to the assignee of the present application.

Although the present invention has been described with reference to specific embodiments and constructions, modifications and adaptations will be readily apparent to those of ordinary skill in the art. The specific figures are for illustrative purposes only, whereas the true scope of the present invention should be determined by reference to the claims appended hereto. Broadly speaking, the cradle 26 is a species of a gating member and even more broadly may be considered as a gating means. Broadly, the gating means such as cradle 26 simultaneously releases one article from a plurality of group zones within storage zone 56S. In the preferred embodiments, the group zones are column zones. Obviously other constructions may be used within the scope of some of the claims appended hereto. Likewise, the escrow members 46B, 46M, 46B', and 46M' are illustrative of an escrow means. Other constructions within the scope of some of the claims appended hereto are likewise possible.

What is claimed is:

1. A dispensing assembly comprising:

(a) a compartment with front, back, right side side, and left side walls;

(b) a storage zone in said compartment and adapted to selectively store a plurality of cylindrical articles in:

I. an n column mode with the articles disposed in n axially-aligned vertical column zones extending from said front wall to said back wall, n is an integer $\geqq 2$, and II. an $(n-1)$ column mode with the articles disposed in $(n-1)$ vertical column zone(s), each said $(n-1)$ column zone overlapping at least two of said n column zones;

(c) a dispensing zone below said storage zone; and (d) a first gate removably mounted in said compartment and operable to gate cylindrical articles into said dispensing zone, said first gate movable between:

I. a holding position wherein it prevents an article from dropping into said dispensing zone, and II. a free position wherein it allows an article to drop into said dispensing zone; and wherein said first gate can not be removed when it is disposed in said holding position and can not be removed when it is disposed in said free position and said first gate can be removed when disposed in between said holding position and said free position.

2. The dispensing assembly of claim 1 further comprising gate accommodating means on one of said side walls adapted for mounting said first gate at least at two different locations.

3. The dispensing assembly of claim 1 wherein said first gate includes an upper arm and a lower arm and said first gate is hingedly mounted on one of said side walls.

4. The dispensing assembly of claim 3 wherein said upper arm has an upper hole and said lower arm has a lower hole and said one of said side walls includes at least an upper peg and a lower peg, said upper peg is operative to extend through said upper hole and prevent the removal of said first gate when it is in said holding position, and said lower peg is operative to extend through said lower hole and prevent the removal of said first gate when it is in said free position.

5. The dispensing assembly of claim 4 further comprising a pocket in said one of said side walls and operable to mount said first gate by receiving a hinge leaf hinged to said first gate.

6. The dispensing assembly of claim 3 wherein said lower arm includes a lower mounting hole and further comprising a first mounting flange extending out from said one of said side walls, and wherein said first gate is mounted by said first mounting flange extending through said lower hole.

7. The dispensing assembly of claim 6 wherein said upper arm includes a flange extending out therefrom.

8. The dispensing assembly of claim 3 further comprising an escrow zone in said compartment between said storage zone and said dispensing zone; a curved cradle blocking movement of articles from said storage zone to said escrow zone and operable for separating the lower-most article in said column zones from the remainder of articles in said column zones and further operable for simultaneously releasing one article from each of said column zones for gravity movement into said escrow zone; and wherein said cradle is operable to hold said first gate in its holding position and said cradle is operable to rotate in order to release said first gate which in turn releases an article to move from said escrow zone to said dispensing zone.

9. The dispensing assembly of claim 8 further comprising a second gate mounted in said compartment and comprising an upper arm and a lower arm and operable to gate cylindrical articles into said dispensing zone, said second gate movable between:

I. a holding position wherein it prevents an article from dropping into said dispensing zone, and II. a free position wherein it allows an article to drop into said dispensing zone; and wherein said second gate cannot be removed when it is disposed in said holding position and cannot be removed when it is disposed in said free position and wherein said second gate can be removed when disposed in between said holding position and said free position.

10. A dispensing assembly comprising:

(a) a compartment with front, back, right side, and left side walls;

(b) a storage zone in said compartment and adapted to selectively store a plurality of cylindrical articles in a column or columns;

(c) a dispensing zone below said storage zone; and (d) a first gate removably mounted in said compartment and operable to gate cylindrical articles into said dispensing zone, and first gate movable between:

I. a holding position wherein it prevents an article from dropping into said dispensing zone, and II. a free position wherein it allows an article to drop into said dispensing zone;

and, said first gate including an upper arm and a lower arm and being pivotable between said holding position and said free position; and wherein said first gate cannot be removed when it is disposed in said holding position and cannot be removed when it is disposed in said free position and said first gate can be removed when disposed in between said holding position and said free position.

11. The dispensing assembly of claim 10 further comprising gate accommodating means on one of said side walls adapted for mounting said first gate at least at two different locations.

12. The dispensing assembly of claim 10 wherein said storage zone is adapted to store a plurality of cylindrical articles in a plurality of axially-aligned vertical column zones and further comprising an escrow zone in said compartment between said storage zone and said dispensing zone; a curved cradle blocking movement of articles from said storage zone to said escrow zone and operable for separating the lower-most article in said column zones from the remainder of articles in said column zones and further operable for simultaneously releasing one article from each of said column zones for gravity movement into said escrow zone; and wherein said cradle is operable to hold said first gate in its holding position and said cradle is operable to rotate in order to release said first gate which in turn releases an article to move from said escrow zone to said dispensing zone.

13. The dispensing assembly of claim 12 wherein said upper arm has an upper hole and said lower arm has a lower hole and said one of said side walls includes at least an upper peg and a lower peg, said upper peg is operative to extend through said upper hole and prevent the removal of said first gate when it is in said holding position, and said lower peg is operative to extend through said lower hole and prevent the removal of said first gate when it is in said free position and further comprising a pocket in said one of said side walls and operable to mount said first gate by receiving a hinge leaf hinged to said first gate.

14. The dispensing assembly of claim 12 wherein said lower arm includes a lower mounting hole and further comprising a first mounting flange extending out from said one of said side walls, and wherein said first gate is mounted by said first mounting flange extending through said lower hole.

15. The dispensing assembly of claim 14 wherein said upper arm includes an upper hole and said mounting flange extends into said upper hole when said first gate is disposed in said free position.

16. The dispensing assembly of claim 14 further comprising a second gate mounted in said compartment and comprising an upper arm and a lower arm and operable to gate cylindrical articles into said dispensing zone, said second gate movable between:

I. a holding position wherein it prevents an article from dropping into said dispening zone, and II. a free position wherein it allows an article to drop into said dispensing zone; and wherein said second gate cannot be removed when it is disposed in said holding position and cannot be removed when it is disposed in said free position and wherein said second gate can be removed when disposed in between said holding position and said free position and wherein said second gate lower arm includes a lower mounting hole and further comprising a second mounting flange extending out from said one of said side walls, and wherein said second gate is mounted by having said second mounting flange extending through said lower hole of said second gate.

17. A dispensing assembly comprising:

(a) a compartment with front, back, right side, and left side walls;
(b) a storage zone in said compartment and adapted to selectively store a plurality of cylindrical articles in a column or columns;
(c) a dispensing zone below said storage zone; and
(d) an escrow zone between said storage zone and said dispensing zone;
(e) a gating member blocking movement of articles from said storage zone to said escrow zone and operable for separating the lower-most article in each column from the remainder of the articles and for releasing articles for gravity movement into said escrow zone; and
(f) a first escrow gate mounted in said compartment and operable to gate cylindrical articles into said dispensing zone, and first gate movable between:
I. a holding position wherein it prevents an article from dropping into said dispensing zone, and
II. a free position wherein it allows an article to drop into said dispensing zone; and said first escrow gate has a planar upper arm and a lower arm and is pivotable between said holding position and said free position; said escrow gate further comprising a camming surface at least partly outside of the plane of said upper arm; and wherein said gating member is operable to hold said first escrow gate in its holding position and said gating member is movable to release said first escrow gate which in turn releases an article to move from said escrow zone to said dispensing zone, and wherein said gating member moves said first escrow gate from its free position to its holding position by contacting said camming surface.

18. The dispensing assembly of claim 17 wherein said camming surface is on a flange extending out from said upper arm and is operable to advance the point on an operating sequence of said gating member at which said first escrow gate will be moved to its holding position.

19. The dispensing assembly of claim 17 wherein said first gate cannot be removed when it is disposed in said holding position and cannot be removed when it is disposed in said free position and said first gate can be removed when disposed in between said holding position and said free position.

20. The dispensing assembly of claim 19 wherein said lower arm includes a lower mounting hole and further comprising a first mounting flange extending out from said one of said side walls, and wherein said first gate is mounted by said first mounting flange extending through said lower hole.

21. The dispensing assembly of claim 20 wherein said gating member is a curved cradle.

22. The dispensing assembly of claim 17 wherein said dispensing assembly is operable in:
I. an n column mode with the articles disposed in n axially-aligned vertical columns extending from said front wall to said back wall, n is an integer $\geqq 2$, and
II. an $(n-1)$ column mode with the articles disposed in $(n-1)$ vertical column(s), each said $(n-1)$ column overlapping at least two of said n columns; and wherein said first escrow gate is positionable at different locations in said escrow zone depending on whether the dispensing assembly is in the n column mode or the $(n-1)$ column mode.

23. The dispensing assembly of claim 22 wherein said lower arm includes a lower mounting hole and further comprising a first mounting flange extending out from said one of said side walls, and wherein said first gate is mounted by said first mounting flange extending through said lower hole.

24. The dispensing assembly of claim 23 wherein said camming surface is on a flange extending out from said upper arm and is operable to advance the point on an operating sequence of said gating member at which said first escrow gate will be moved to its holding position.

25. The dispensing assembly of claim 24 further comprising a spring-loaded elevator plate removably mounted in said cradle to adapt said cradle for operation with relatively small diameter cylindrical articles.

* * * * *